US011910894B2

(12) United States Patent
Gómez Núñez et al.

(10) Patent No.: US 11,910,894 B2
(45) Date of Patent: Feb. 27, 2024

(54) PROTECTIVE PACKAGING FOR SUITCASES

(71) Applicant: VINGBOX IBÉRICA, S.L., Marbella (ES)

(72) Inventors: José Ignacio Gómez Núñez, Madrid (ES); Jorge Fernández Carmona, Madrid (ES)

(73) Assignee: VINGBOX IBÉRICA, S.L., Marbella (ES)

( * ) Notice: Subject to any disclaimer, the term of this patent is extended or adjusted under 35 U.S.C. 154(b) by 0 days.

(21) Appl. No.: 18/248,374

(22) PCT Filed: Oct. 8, 2021

(86) PCT No.: PCT/ES2021/070736
§ 371 (c)(1),
(2) Date: Apr. 7, 2023

(87) PCT Pub. No.: WO2022/074279
PCT Pub. Date: Apr. 14, 2022

(65) Prior Publication Data

US 2023/0389670 A1 Dec. 7, 2023

(30) Foreign Application Priority Data

Oct. 9, 2020 (ES) ..... ES202032200U

(51) Int. Cl.
*B65D 81/02* (2006.01)
*A45C 13/00* (2006.01)

(52) U.S. Cl.
CPC ..... *A45C 13/002* (2013.01)

(58) Field of Classification Search
CPC ..... A45C 13/42; A45C 13/08; A45C 13/008; A45C 13/18; A45C 2007/0004;
(Continued)

(56) References Cited

U.S. PATENT DOCUMENTS 2,711,234 A * 6/1955 Rubens ..... A45C 13/002 383/117
10,485,314 B2 * 11/2019 Teran ..... A45C 5/06
(Continued)

FOREIGN PATENT DOCUMENTS

CN 208176243 U 12/2018
DE 202013000249 U1 2/2013
(Continued)

OTHER PUBLICATIONS

International Search Report, dated Feb. 11, 2022, for corresponding International Application No. PCT/IE2021/070736 with English translation (7 pages).
(Continued)

*Primary Examiner* — King M Chu
(74) *Attorney, Agent, or Firm* — Intellectual Property Law Group LLP

(57) ABSTRACT

Suitcase protector comprising a cardboard packaging, characterised by the fact that it is made from the development of a die-cut sheet of cardboard, in which a rectangular, horizontally elongated, major section is defined, which, by means of vertical folding lines, determines the two major (1-1') and minor (2 2') sides of a rectangular prismatic container, which by means of vertical folding lines determine the two larger (1-1') and smaller (2 2') sides of a rectangular prismatic container.

2 Claims, 3 Drawing Sheets

(58) Field of Classification Search
CPC ..... A45C 11/00; B65D 81/022; B65D 81/02; B65D 81/05; B65D 81/00
USPC ..... 206/37, 521, 320
See application file for complete search history.

(56) References Cited

U.S. PATENT DOCUMENTS

| | | | | |
|---|---|---|---|---|
| 2007/0204943 | A1 | 9/2007 | Beakey | |
| 2010/0193312 | A1* | 8/2010 | Mehta | A45C 5/14 190/125 |
| 2016/0066669 | A1* | 3/2016 | Lien | A45C 13/002 206/459.5 |

FOREIGN PATENT DOCUMENTS

| | | | |
|---|---|---|---|
| DE | 102013000350 | A1 | 7/2014 |
| EP | 2174564 | A1 | 4/2010 |
| WO | WO 2006053921 | A1 | 5/2006 |

OTHER PUBLICATIONS

Written Opinion of the ISA, dated Feb. 11, 2022, for corresponding International Application No. PCT/ES2021/070736 (5 pages).
International Search Report, dated Feb. 11, 2022, for corresponding International Application No. PCT/ES2021/070736 with English translation (7 pages).

* cited by examiner

PROTECTIVE PACKAGING FOR SUITCASES

CROSS-REFERENCE TO RELATED APPLICATIONS

This application is a U.S. National Phase application, under 35 U.S.C. § 371, of International Application no. PCT/ES2021/070736 with an international filing date of Oct. 8, 2021, and claims benefit of Spanish Application no. U202032200 filed on Oct. 9, 2020; each of which is hereby incorporated by reference in its entireties for all purposes.

FIELD OF THE INVENTION

The present invention relates to a protective packaging for suitcases whose evident purpose is to provide a means of protection for suitcases, especially designed for use in airports, bus stations, train stations and the like. The object of the invention is to provide a means which, in addition to protecting the suitcase against knocks, scratches and the like, determines a means of evidencing any tampering with the suitcase. The invention aims to provide a new protective means, with which, once implemented, the suitcase can be used conventionally, i.e., leaving its telescopic handle and wheels operational, all with a more ecological and environmentally friendly structure, 100% recyclable.

BACKGROUND OF THE INVENTION

As is well known, when travelling on planes, buses and even trains, if the suitcases exceed a certain volume, they must be stored in the cargo hold or in receptacles separate from the passenger, which makes it possible for them to be tampered with, for example to remove belongings contained in them. In an attempt to avoid this problem, there are known packing services in which the suitcase is rolled up a large number of times with a transparent plastic film, so that removing the film is a significant waste of time that tends to discourage any opportunist, as well as highlighting any tampering manoeuvre. The fundamental problem with this system is that it involves the use of a large volume of plastic, with the environmental problem that this entails.

SUMMARY OF THE INVENTION

The recommended protective packaging for suitcases solves the above-mentioned problem in a fully satisfactory manner, based on a simple but effective solution. More specifically, the packaging of the invention is based on a prismatic cardboard box, with an elongated rectangular base, in short, of dimensions in accordance with the suitcase to be contained inside, obtained from the development of a die-cut cardboard sheet, in which, from a horizontally elongated rectangular sector, with four vertical folding lines. The four side walls of the box and the closing flange are defined by gluing the box with four vertical folding lines in order to obtain a foldable and easy to assemble tubular body, in which only the bottom and the upper base need to be assembled as described below.

From the lower edges of the side walls emerge four tabs with their corresponding folding lines, with double-sided adhesive tape and cut-outs which, when assembled, provide recesses for the wheels of the suitcase. Once assembled, the lower side cannot be removed due to the aforementioned adhesive.

Four folding flaps also emerge from the upper edges of the side walls of the case, also equipped with adhesive for gluing them together, and with cut-outs which provide a window for the telescopic handle of the case.

One of these flaps, specifically the one linked to one of the larger sides, will have a longitudinal tear line that allows the user to access the inside of the container by tearing it once the journey has been completed.

Finally, it only remains to be noted that the smaller side walls of the box may also include tear lines which determine the respective rectangular windows for access to the manual grip handle which some cases have on one of their smaller side walls. The following advantages are derived from this structure: 100% ecological, recyclable and environmentally friendly product, which avoids the use of plastics; easier (and less time-consuming) installation and removal; offers a higher level of protection to the case against knocks and scratches; inviolable system that prevents any type of tampering with it; it offers a large labelable surface, ideal for advertising; and improves the stability of the luggage in the cargo hold, as it is a perfectly prismatic-rectangular body.

BRIEF DESCRIPTION OF THE DRAWINGS

In order to complement the description to be given below and in order to help a better understanding of the characteristics of the invention, in accordance with a preferred example of its practical application, a set of drawings is included as an integral part of this description, in which the following has been shown for illustrative and non-limiting purposes.

DETAILED DESCRIPTION OF SPECIFIC EMBODIMENTS

Figure 1:
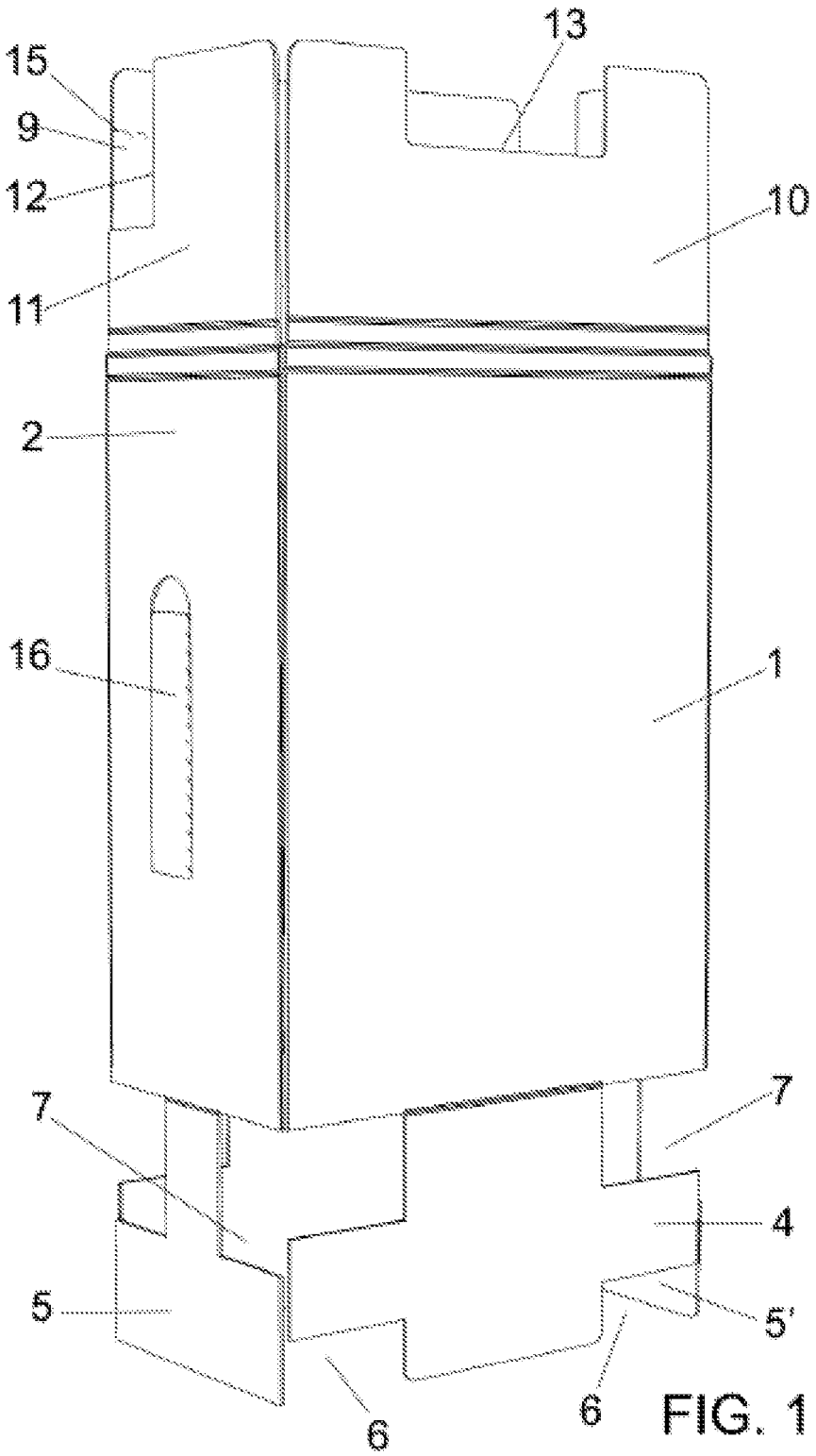
FIG. 1 shows a perspective view of a protective packaging for suitcases made in accordance with the object of the present invention, in an initial phase of deployment for its assembly.
Figure 2:
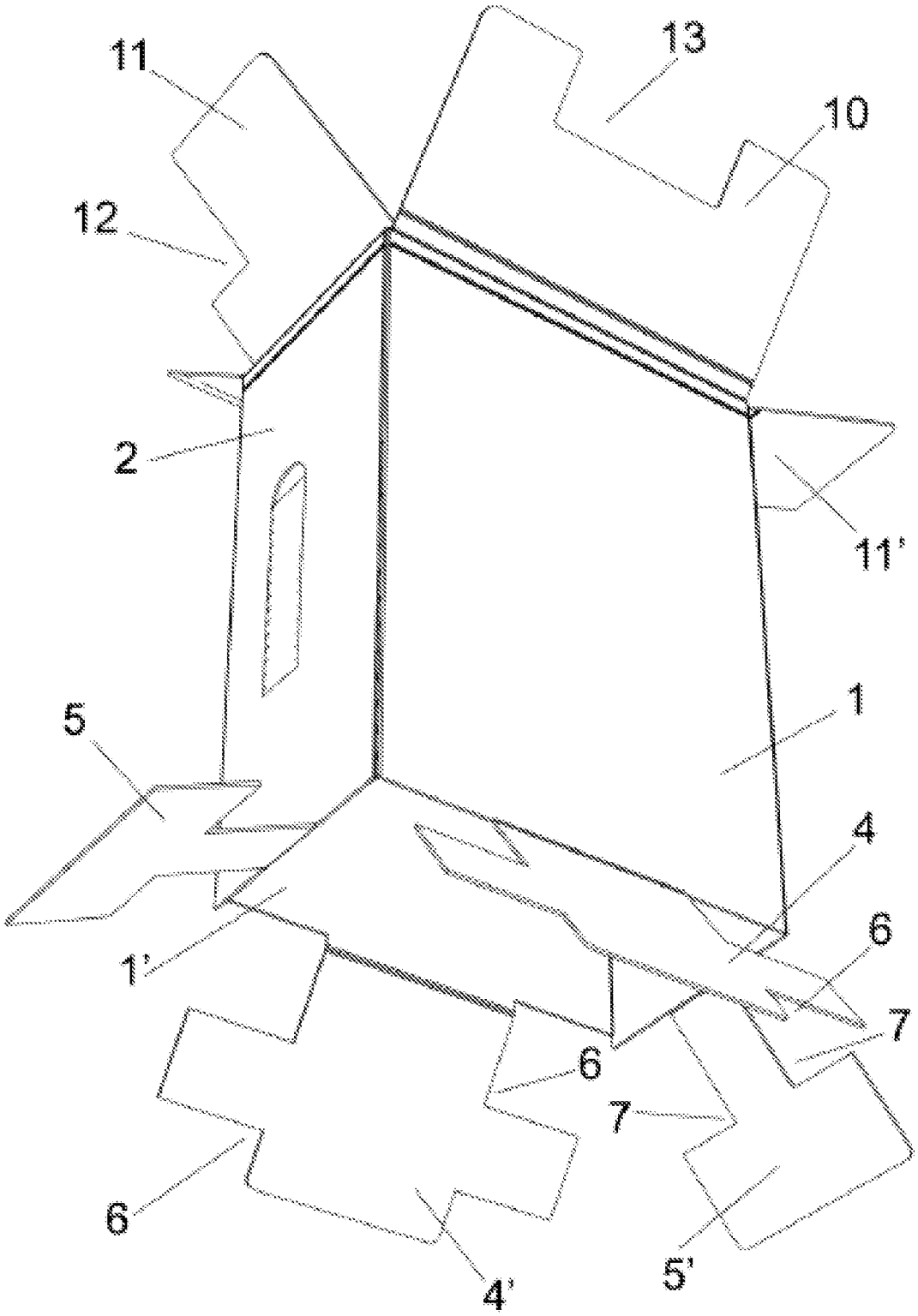
FIG. 2 shows a side-bottom perspective view of the packaging of the previous figure.
Figure 3:
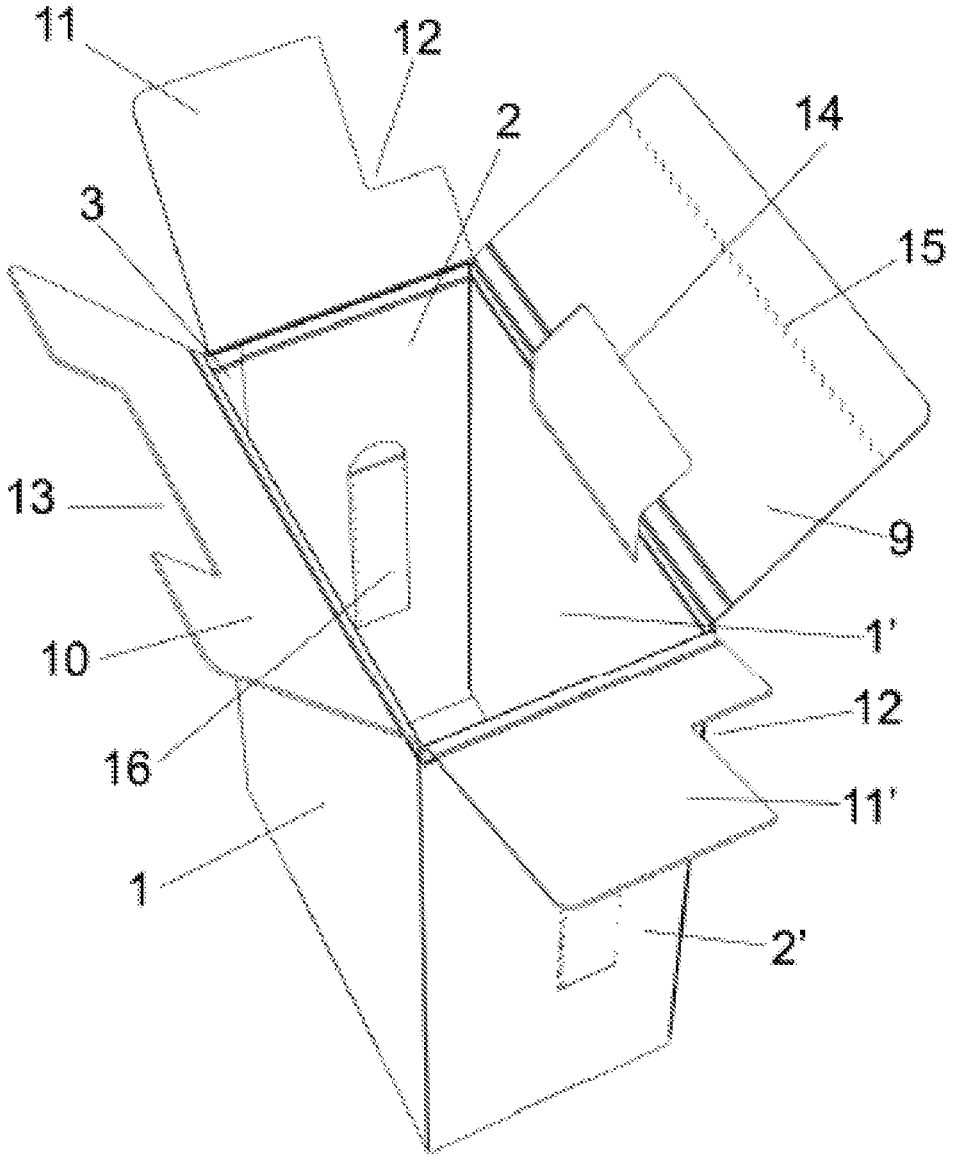
FIG. 3 shows a perspective view of the packaging with the bottom assembled, and with its upper mouth open.

In view of the above figures, it can be seen that the packaging of the invention is made from the development of a die-cut sheet of cardboard, in which a rectangular, horizontally elongated, majority sector is defined, which by means of vertical folding lines determines the two larger (1-1') and smaller (2-2') sides of a rectangular prismatic container. The prism is formed by attaching a tab (3) associated laterally to one of the larger sides (1) and fixed to the free smaller side (2), as shown in FIG. 3, with the particularity that from the lower edges of the larger sides (1-1') emerge larger tabs (4-4') with their corresponding folding lines, the smaller sides (2-2') have smaller flaps (5-5'), all of which are intended to form the bottom by gluing them together with double-sided adhesive tape, not shown in the figures, which will be supplied attached to one of these flaps, the other side of which will be protected with waxed or siliconized paper that will be removed when the box is assembled, the larger flanges (4-4') have rectangular recesses (6) that affect both their inner and outer corners, while the smaller flanges have rectangular recesses (7) that only affect their inner corners, so that when the bottom is assembled, both recesses create windows for the wheels of the suitcase to be packed.

As for the upper mouth of the packaging, in correspondence with the upper edges of the walls or larger side faces (1-1') there is a front flap (10) and a rear flap (9), the former with a "U" cut-out (13) on its free upper edge, while the latter incorporates a rectangular cut-out (14) in correspondence with the hinged area of the said flap, and which partially affects the upper end of said larger side face (1'), while from the smaller side faces (2-2') emerge two smaller tabs (11-11') which include an "L" shaped recess (12) on their rear and upper edge, so that these recesses coincide in the closure of the upper mouth of the container, forming a single common window through which the telescopic handle of the suitcase can be extracted.

For this closure, once the suitcase has been inserted into the suitcase in the correct orientation, the smaller tabs (11-11') are folded, then the front tab (10), and finally, after removing the corresponding sheet of paraffin paper laid on one or more double-sided adhesives fixed to the inside face of the rear tab (9), this tab is fixed immovably on the front tab (10).

The rear flap (9), the only one visible once the container is closed, shall have a longitudinal tear line (15) that allows the gluing area of the said flap to be separated from the front flap, so that in order to remove the suitcase, the said tear line must be broken, thus showing that it has been tampered with.

Finally, it only remains to point out that the smaller side faces are susceptible of incorporating rectangular climbing lines (16) in their middle area, determining windows for the passage of the corresponding manual grip handle that some suitcases incorporate in one of their side faces.

What is claimed is:

1. A suitcase protector comprising a cardboard packaging, wherein the cardboard packaging is made from a development of a die-cut sheet of cardboard, in which a rectangular, horizontally elongated, major section is defined, which, by means of vertical folding lines, determines two larger (1-1') and two smaller (2 2') side faces of a rectangular prismatic container, which by means of the vertical folding lines that determine the two larger (1-1') and the two smaller (2 2') side faces of the rectangular prismatic container, the prismatic container is formed by attaching a tongue (3) associated laterally to one of the larger side faces (1) and fixed by adhesive to a free smaller side face (2), forming a foldable rectangular prism, with the particularity that from lower edges of the larger (1-1') and smaller (2-2') side faces, folding flanges emerge with an adhesive fixing means determining a bottom of the container, in which a plurality of bottom recesses are provided at a plurality of corners of the folding flanges, determining a set of windows for wheels of the suitcase to be packed, wherein an upper mouth of the container includes a pair of smaller closing tabs (11-11'), which are complemented by a front tab (10) and a rear tab (9), equipped with means of attachment by means of adhesive, as well as a plurality of upper recesses that determine a top window for passage of a telescopic handle of the suitcase; and the rear tab (9) includes a longitudinal tear line (15) that allows a gluing area of said rear tab to be separated from the front tab (10).

2. The suitcase protector comprising a cardboard packaging according to claim 1, wherein on at least one of the smaller side faces of the container and in correspondence with a middle area of the at least one smaller side face, there are rectangular climbing lines (16) that determine a side window for passage of a corresponding grip handle for manual gripping of the suitcase.

* * * * *